United States Patent [19]

Cochran et al.

[11] Patent Number: 4,526,730

[45] Date of Patent: Jul. 2, 1985

[54] HOME CARBONATING APPARATUS

[76] Inventors: Daniel M. Cochran, Rte. 5, Wheller Rd., WL-9; William H. Wyttenbach, Rte. 5, Wheller Rd., WL-12, both of Louisville, Tenn. 37777

[21] Appl. No.: 462,556

[22] Filed: Jan. 31, 1983

[51] Int. Cl.[3] ..... B01F 3/04

[52] U.S. Cl. ..... 261/121 R; 99/323.1; 141/17; 261/DIG. 7; 426/477

[58] Field of Search ..... 261/121 R, DIG. 7; 141/17; 426/477; 99/323.1

[56] References Cited

U.S. PATENT DOCUMENTS

| | | | |
|---|---|---|---|
| 629,752 | 7/1899 | Murray | 261/DIG. 7 |
| 1,905,986 | 4/1933 | Jacobs et al. | 261/DIG. 7 |
| 2,073,273 | 3/1937 | Wetstein | 261/DIG. 7 |
| 2,170,531 | 8/1939 | Kahn | 426/477 X |
| 2,190,688 | 2/1940 | Snelling | 426/477 X |
| 2,220,146 | 11/1940 | Curry | 261/DIG. 7 |
| 2,345,081 | 3/1944 | Ward | 261/121 R X |
| 2,805,846 | 9/1957 | Dewan | 261/DIG. 7 |
| 4,298,551 | 11/1981 | Adolfsson et al. | 261/121 R |
| 4,342,710 | 8/1982 | Adolfsson et al. | 261/121 R |
| 4,457,877 | 7/1984 | Love et al. | 141/17 X |

FOREIGN PATENT DOCUMENTS

| | | | |
|---|---|---|---|
| 52210 | 2/1933 | Norway | 261/DIG. 7 |

*Primary Examiner*—Richard L. Chiesa

*Attorney, Agent, or Firm*—James C. Kesterson

[57] ABSTRACT

Apparatus for adding carbon dioxide to consumable liquids contained in a container having an aperture of a selected size and shape is disclosed. The apparatus (10) comprises a housing (16) having a cartridge cavity (46), and a connecting means (20), (76) and (98) for securing the mouth (26) of a liquid container (12) thereto. Attached to the housing (16) is a gas conduit (28) having a first end (30) and a further end (32) which extends to the bottom of the liquid container (12). A gas cartridge (34) containing pressurized $CO_2$ is received in cartridge cavity (46) in a gas-tight manner. The apparatus includes activating means such as a piercing member (48) for rupturing a frangible seal (54) of the cartridge (34). When the frangible seal (54) of the disposable one shot cartridge (34) is ruptured, the pressurized $CO_2$ gas passes through the housing (16), down the connecting tube (28) and out end (32) such that the carbon dioxide bubbles (38), (40), (42) and (44) bubble up through the liquid beverage (14) thereby effecting carbonation. Also included in the device are adaptors (76) and (98) which allow containers having various mouths or apertures to be operated with the apparatus of this invention.

13 Claims, 4 Drawing Figures

HOME CARBONATING APPARATUS

DESCRIPTION

1. Technical Field

This invention relates generally to the carbonation of liquid beverages, and more particularly to apparatus for carbonating or recarbonating liquid beverages in standard and original containers. The recarbonating apparatus is small and inexpensive and uses one shot disposable carbon dioxide ($CO_2$) cartridges which cartridges have only sufficient pressurized $CO_2$ to carbonate a single bottle thereby reducing the danger of shattered containers.

2. Background Art

Carbonated beverages or various types of soft drinks, colas, and some types of wine and are readily purchased at grocery stores, food markets and the like. In addition, other traditionally carbonated drinks such as chocolate sodas and the like are substantially limited to being purchased from the fountain of drug stores, ice cream shops, etc. However, it is well recognized that these consumable beverages make up a part of our everyday life.

Perhaps the most common of these carbonated beverages are the individually bottled cola and soft drink beverages which may be purchased from stores, and machines, either in cans or disposable bottles. However, to decrease cost some types of colas and soft drink beverages are now available in large or family size containers and include a resealable top to prevent the loss of carbonation before the beverage has been completely consumed. Unfortunately, small children as well as adults often carelessly leave the resealable top off one of these large containers after only a small amount of the beverage has been withdrawn. Consequently, after only a few hours (and in hot weather, perhaps even after a few minutes) the carbon dioxide dissolved in the beverage which creates the carbonation will leave the beverage uncarbonated and most distasteful. Certainly most families have experienced frustration of throwing out a substantially full two liter container of soft drink after such a beverage has lost its carbonation.

Therefore, it is an object of this invention to provide simple and inexpensive apparatus for recarbonating beverages which have gone flat or lost their carbonation.

It will also be appreciated that in addition to the standard cola and soft drink beverages normally available commercially, interesting taste experiences may be achieved by the carbonation of other beverages such as fresh orange juice, chocolate milk (chocolate fizzie) and perhaps various types of alcoholic beverages which are not presently available.

Therefore, another object of this invention is to provide apparatus for the general carbonating of consumable beverages and liquids.

At present, most home carbonation of beverages has been accomplished by devices commonly called syphon or seltzer bottles wherein a liquid container is completely filled or substantially filled with water, after which, high pressure $CO_2$ is combined with the water under pressure such that when the carbonation is desired a valve may be opened such that a stream of the pressurized carbonated water may be directed into the beverage to be carbonated. This type carbonation is most commonly used with respect to alcoholic beverages such as, for example, whiskey and soda. An example of a typical type syphon or seltzer bottle and carbonated water that is produced under pressure for carbonating drinks is disclosed in U.S. Pat. No. 2,345,081 issued to L. T. Ward on Mar. 28, 1944.

In addition to the seltzer or syphon bottles, other types of apparatus for carbonating beverages are disclosed in the Adolfsson, et.al. Patents, one of which has U.S. Pat. No. 4,298,551 issued Nov. 3, 1981, and the second of which has U.S. Pat. No. 4,342,710 issued on Aug. 3, 1982. Although these two patents do disclose a technique for the carbonation or recarbonation of beverages, the apparatus is complex and operates with an extremely high pressure $CO_2$ bottle to assure a sufficient volume of $CO_2$ under pressure to carbonate large numbers of containers full of suitable beverages. In fact, the operating pressure of the $CO_2$ bottle used in this type device is typically between about 15 and 20 bar which is so high, that during the pressurization process the container having the liquid must be enclosed in a protective shield in the event of a dangerous explosion of the bottle or liquid container.

Therefore, it is another object of this invention to provide a safe and simple apparatus for carbonating beverages in standard containers.

DISCLOSURE OF THE INVENTION

Other objects and advantages will inpart be obvious, and will inpart appear hereinafter, and will be accomplished by the present invention which discloses apparatus for adding carbon dioxide ($CO_2$) to consumable liquids contained in an ordinary container which has an aperture or mouth of a selected size and shape. The apparatus comprises a housing which defines a cartridge cavity of selected shape, and a connecting means for securing the housing to the aperture of the container in an air-tight manner. The housing further defines a gas-tight pathway extending between a first port at the connecting means and a second port at the cartridge cavity. Also included is a gas conduit means which has a first end connected in a gas-tight manner to the housing pathway at the first port. Thus, when the housing is secured to the liquid container, the further end of the gas conduit extends into the interior of the liquid container and proximate the bottom of the container so that a continuous gas-tight pathway exists between the cartridge cavity in the housing to the open end of the gas conduit located proximate the bottom of the liquid container. The housing also includes a means for opening or alternatively sealing the cartridge cavity closed to the atmosphere in a pressure-tight manner. The apparatus further includes a disposable one shot carbon dioxide, $CO_2$, cartridge having a frangible seal and a shape suitable for being received in the cartridge cavity. The one shot sealed cartridge having a volume of 0.216 Liters at about 40° F. to room temperature contains the carbon dioxide under 95 PSI to 700 PSI of pressure. Activating mechanism is also provided for rupturing the frangible seal of the disposable one shot $CO_2$ cartridge when the cartridge cavity is sealed from the atmosphere to contain pressure such that as the pressurized carbon dioxide, $CO_2$, escapes from the cartridge cavity it travels through the pathway and through the gas conduit to the bottom of the container where the pressurized $CO_2$ gas bubbles up through the consumable beverage in the container thereby carbonating the beverage.

In a preferred embodiment, the cartridge cavity has a shape similar to and suitable for receiving the portion of the disposable cartridge having the frangible seal and also includes a piercing member such that when the cartridge is fully received and seated within the cartridge cavity, the piercing means will penetrate the frangible seal. To accomplish this, the means for selectively opening and sealing the cartridge cavity is suitable for forcing the cartridge to its fully seated position after pressurized sealing has been effected.

BRIEF DESCRIPTION OF THE DRAWINGS

The above-mentioned features of the present invention will be more clearly understood from the consideration of the following description in connection with the accompanying drawings which.

BEST MODE FOR CARRYING OUT THE INVENTION

Figure 1:
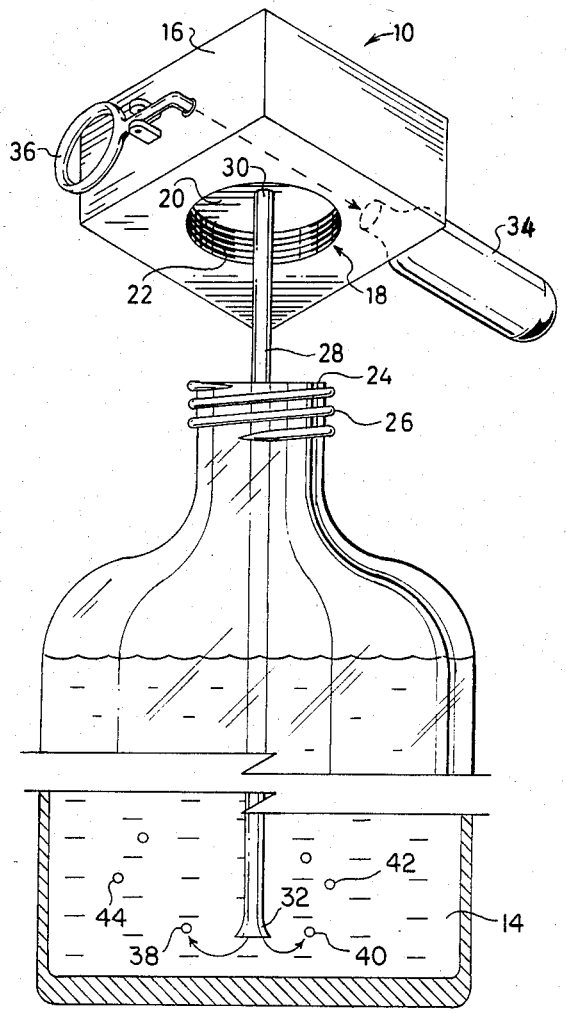
FIG. 1 is a perspective view of the apparatus of this invention cooperating with an ordinary beverage container.

Referring now to FIG. 1, there is shown generally at 10 the apparatus of this invention prior to being connected or sealed to an ordinary beverage container 12 containing a liquid beverage 14. As shown, the apparatus 10 includes a housing 16 having a connecting means 18 which in the example shown is simply a recess 20 having threads 22 for receiving the aperture or mouth 24 of container 12. In the embodiment shown, of course, the mouth 24 of container 12 has matching threads 26 suitable for cooperating with threads 22 of recess 20. Further as shown, there is also a gas conduit 28 having a first end 30 extending from said recess 20 of housing 16 to a further end 32 which, in the embodiment shown, extends proximate the bottom of container 12 when the device 10 is secured to container 12. Also included is a pressurized $CO_2$ cartridge 34 containing $CO_2$ (carbon dioxide) at a selected pressure. It is believed that a cartridge at about room temperature having a volume of 0.216 Liters of $CO_2$ at between 95 PSI and 700 PSI can safely and effectively be used with most standard sized beverage containers of between one pint and three liters. However a pressure of between 370 PSI and 555 PSI is preferable for a standard two liter container. In any event, the pressure contained in the $CO_2$ cartridge should provide a resulting pressure of between 20 PSI and 150 PSI in the beverage container when it is about one half full (in one liter of air space) at about 40° F. and preferably a resulting pressure of between 80 PSI and 120 PSI. The required correspondence cartridge (standard 0.216 Liter) pressure to achieve 20, 80, 120 and 150 PSI in a half full container and at a constant temperature may of course be determined by its standard equation $PV=nRT$. The resulting values are 95, 370, 555 and 695 PSI respectively. The cartridge 34 may be activated or ruptured to allow the escape of the carbon dioxide according to one embodiment by means of activating mechanism 36. Once the carbon dioxide is allowed to escape from cartridge 34, in a manner to be discussed hereinafter, it passes into gas conduit 28 and out further end 32 of said conduit as bubbles of $CO_2$ 38, 40, 42 and 44, which move up through the beverage 14 contained in liquid container 12. As will be appreciated by those skilled in the art, the beverage will absorb more of the $CO_2$ when it is at a low temperature. Therefore, the beverage should be chilled prior to carbonation.

Figure 2:
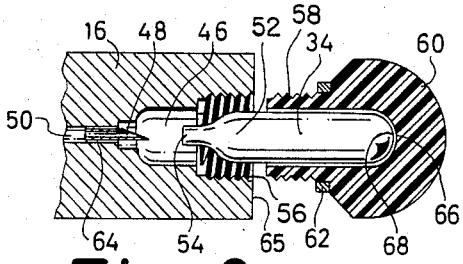
FIG. 2 shows a preferred embodiment for sealing the cartridge cavity and for effectively rupturing the frangible seal of a pressurized $CO_2$ cartridge.

Referring now to FIG. 2, there is shown a preferred embodiment for both containing the carbon dioxide cartridge 34 and for effectively rupturing the cartridge to allow the $CO_2$ to escape. As shown, housing 16 defines a cartridge cavity 46 having a piercing member 48 connected to a gas pathway 50 defined by the housing 16. As shown, the cartridge cavity 46 has a shape and size similar to and suitable for receiving portion 52 of cartridge 34. Portion 52 of the cartridge includes a frangible seal member 54 which may be ruptured to allow the escape of the pressurized $CO_2$. Also as shown, the cavity 46 joins a threaded recess portion 56 suitable for receiving a mating thread portion 58 of the cartridge cavity cover 60. Cartridge cavity cover 60 also includes a seal 62 such that the cavity 46 is tightly sealed and will withstand the pressure of carbon dioxide in cartridge 34. Opening 64 proximate piercing member 48 defines a first port of gas pathway 50 defined in housing 16. In the embodiment shown in FIG. 2, the rupturing or piercing of the frangible seal 54 of cartridge 34 will be achieved by placing the cartridge in the cavity up against piercing member 48 and then threading the threaded portion 50 of cavity cover 60 into its receiving threads 56 of housing 16. As the cover 60 is screwed into place, 62 will contact face 65 thereby effecting a gas-tight seal. Further, as cover 60 is continued to be tightened and after the contact is made between gasket 62 and face 65, portion 66 of cover 60 will contact the end portion 68 of cartridge 34 so that as the cover is further tightened into place portion 66 of cover 60 will force the frangible seal 54 of cartridge 34 against piercing member 48 until the seal 54 is ruptured and the pressurized $CO_2$ in cartridge 34 is allowed to escape.

Figure 3:
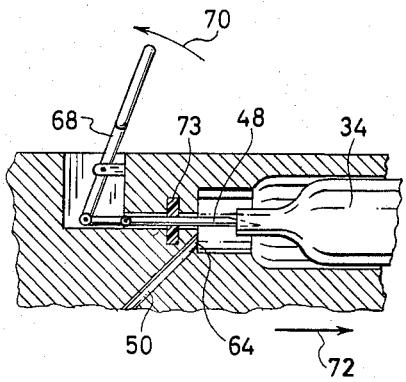
FIG. 3 shows an alternative embodiment wherein rupturing of the frangible seal is accomplished by a piercing member which can be forced through the frangible seal once the cartridge is in place.

Even though the technique used in FIG. 2 is considered to be the simplest and perhaps the preferred embodiment for rupturing the frangible seal 54 of a cartridge, FIGS. 1 and 3 show alternate embodiments whereby rotation of lever 68 in the direction shown by arrow 70 will force the piercing member 48 in the direction indicated by arrow 72 so that the frangible seal may be pierced. However in such an embodiment, piercing member 48 must include pressure sealing such as gasket 73, and the piercing member 48 will be disposed a small distance from port 64 of pathway 50.

Further, although the $CO_2$ cartridge is illustrated as being of a common shape, it is intended that cartridges of any shape and with or without readily identifiable frangible portions be included in the scope of this invention.

Figure 4:
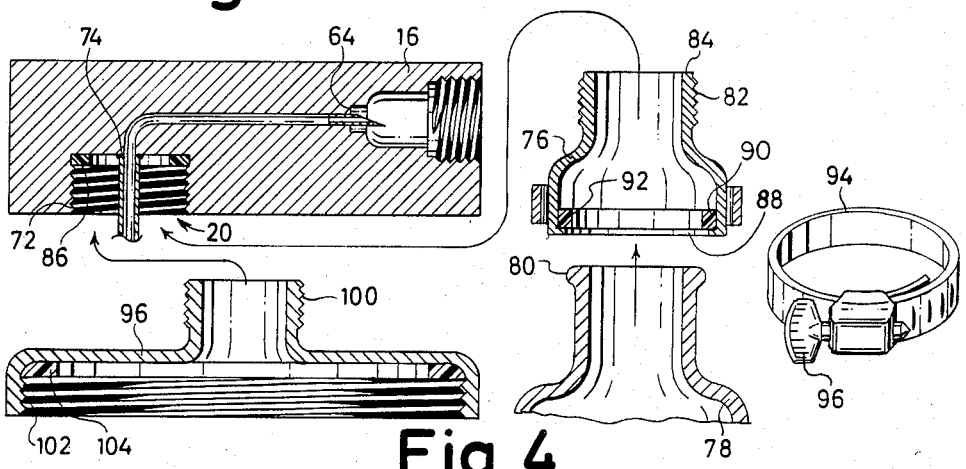
FIG. 4 shows a cross-section of the present invention along with adaptors suitable for allowing the apparatus to be used with beverage containers having different size apertures or openings.

FIG. 4 shows a cross-sectional plan view of the device 10 and better shows how housing 16 defines pathway 50 between a first, port 74 and second port 64 discussed above. FIG. 4 also shows how a series of adaptors such as adaptor 76 which may be used to allow different types of ordinary liquid containers having different type apertures or mouths to be used with the device. For example, although many beverages are contained in a two liter type container having threads 26 such as shown in FIG. 1, which threads 26 match with threads 22 of recess 20 in housing 16, it will be appreciated that many type of beverage bottles include a mouth or aperture opening more similar to that of bottle 78 shown in FIG. 4. This type of bottle simply includes a lip or rim 80 by which a cap and seal is swedged tight around lip 80. Thus, the adaptor 76 as shown, includes threads 82 similar to the threads 26 on the container 12 of FIG. 1. The adaptor 76 may be screwed fully into place in recess 20 until surface 84 comes in contact with gasket 86. Once the adaptor is in place the bottle 78 with lip 80 may be inserted into the opening 88 with the lip 80 resting against soft gasket 90 held in recess 92 of adaptor 76. The gasket 90 may then be tightly clamped around lip 80 of bottle 78 to achieve a gas-tight seal, the apparatus is then used in a manner previously described. Although any type of clamp or tightening band may be used, the metal band 94 having a suitable thumb screw 96 for tightening gasket 90 around lip 80 is suitable.

In addition to bottles which have a lip 80 there may also be included adaptors similar to adaptor 98 which allows containers having a different size mouth or aperture opening to operate with the apparatus of this invention. As shown, there is included a threaded portion 100 operated similar to threaded portion 82 of adaptor 76. In addition, there is included a second threaded portion 102 for receiving liquid containers having apertures or mouths of a larger diameter. To insure a gas-tight seal, there is also included a gasket 104.

Thus, although the present invention has been described with respect to a specific apparatus and design for providing recarbonation or initial carbonation of consumable beverages, it is not intended that such specific references be considered as limitations upon the scope of this invention except as so far as set forth in the following claims.

We claim:

1. Apparatus for adding carbon-dioxide ($CO_2$) to consumable liquids contained in a container having an aperture of a selected size and shape, said apparatus comprising:

a unitary and solid housing defining a threaded connecting cavity for securing said housing to said aperture of said liquid container in a gas tight manner, said housing further defining a cartridge cavity and a single fluid pathway extending between a first port terminating at said connecting cavity and a second port terminating at said cartridge cavity, said pathway being the sole fluid passage in said housing;

gas conduit means having a first and further end, said first end of said gas conduit permanently connected in a gas tight manner to said fluid pathway at said first port such that when said housing is secured to said liquid container said further end of said gas conduit means extends in to the interior of said liquid container so that a continuous gas tight pathway exists from said further end of said gas conduit, through said conduit, through said pathway in said housing to said cartridge cavity;

cover means for selectively opening and closing said cartridge cavity to provide pressurized sealing thereof;

a one shot disposable cartridge having a frangible portion and a shape suitable for being received in said cartridge cavity, said one shot sealed cartridge containing carbon-dioxide ($CO_2$) under pressure; and actuating means for rupturing said frangible portion of said one shot disposable cartridge when said cartridge is in said sealed condition for containing pressure such that said pressurized carbon dioxide escapes from said cartridge cavity through said pathway in said housing and out of said further end of said gas conduit so that bubbles of pressurized $CO_2$ move up through a consumable liquid contained in said liquid contained in said liquid container thereby carbonating said liquid.

2. The apparatus of claim 1 wherein said cartridge cavity has a shape similar to and for selectively receiving that portion of said disposable cartridge having said frangible portion, said actuating means further including a piercing member such that when said cartridge is fully received and seated within said cartridge cavity, said piercing means penetrates through said frangible portion, and wherein said means for selectively opening and sealing said cartridge cavity is suitable for forcing said cartridge into said fully seated position after pressurized sealing has been effected.

3. The apparatus of claim 2 and further including an adaptor, said adaptor having a first portion suitable for connecting to said connecting cavity in a gas-tight manner, and a second portion for receiving an aperture of a liquid container having a different size and shape aperture such that liquid containers of different types may operate with said apparatus.

4. The apparatus of claim 1 wherein said cartridge cavity has a shape similar to and for selectively receiving that portion of said disposable cartridge having said frangible portion, and said actuating mechanism further includes a selectively movable piercing member such that when said cartridge is fully received and seated within said cavity, said piercing means may be activated to penetrate through said frangible portion.

5. The apparatus of claim 4 and further including an adaptor, said adaptor having a first portion suitable for connecting to said connecting cavity in a gas-tight manner, and a second portion for receiving an aperture of a liquid container having a different size and shape aperture such that liquid containers of different types may operate with said apparatus.

6. The apparatus of claim 1 and further including an adaptor, said adaptor having a first portion suitable for connecting to said connecting cavity in a gas-tight manner, and a second portion for receiving an aperture of a liquid container having a different size and shape aperture such that liquid containers of different types may operate with said apparatus.

7. The apparatus of claim 1 wherein said disposable cartridge contains 0.216 Liters of carbon dioxide at a pressure of between 95 PSI and 695 PSI at about room temperature.

8. The apparatus of claim 1 wherein said pressure in said cartridge produces between 20 PSI and 150 PSI pressure in said container.

9. Apparatus for carbonating a beverage by adding carbon dioxide to the beverage when said beverage is contained in its original container, and wherein said original container has an aperture or mouth of a selected size and shape, said apparatus comprising:

a unitary and solid housing defining a threaded connecting cavity suitable for receiving the mouth of said original container for securing said housing to said original container in a gas-tight manner, and wherein said housing further defines a cartridge cavity and a single fluid pathway extending between a first port terminating at said connecting cavity and a second port terminating at said cartridge cavity, said pathway being the sole fluid passage in said housing;

a gas conduit tube having a first and further end, said first end of said conduit tube permanently connected in a gas tight manner to said fluid pathway at said first port such that when said housing is secured to said liquid container, said further end of said gas conduit tube extends to the interior and proximate the bottom of said original container so that a continuous gas-tight pathway exists from said further end of said gas conduit tube, through said conduit tube, through said pathway in said housing to said cartridge cavity;

a removable cover for opening and selectively sealing in a gas-tight manner said cartridge cavity;

a one shot disposable cartridge having a frangible seal and said cartridge having a shape substantially the same as said cartridge cavity, said one shot cartridge sealed container having carbon dioxide pressurized to provide a pressure of between 80 PSI and 120 PSI in said original container when said container is about half full; and actuating mechanism for rupturing said frangible seal of said one shot disposable cartridge such that when said disposable cartridge is inserted in said cartridge cavity and said cover means is in place to seal such cartridge cavity in a gas-tight manner, said mechanism may be activated to rupture said frangible seal such that said pressurized carbon dioxide gas escapes from said cartridge cavity through said pathway and out of said gas tube so that said bubbles of $CO_2$ move up through said beverage contained in said original liquid container thereby carbonating said beverage.

10. The apparatus of claim 9 wherein said cartridge cavity has a shape similar to, and for selectively receiving that portion of said disposable cartridge having said frangible seal, and further including a piercing member such that when said cartridge is fully received and seated within said cavity said piercing member penetrates through said frangible seal by further twisting said closing member such that said closing member forces said cartridge into said fully seated position after pressurized sealing has been effected.

11. Apparatus for adding carbon-dioxide ($CO_2$) to consumable liquids contained in a container having an aperture of a selected size and shape, said apparatus comprising:

a unitary and solid housing defining a threaded connecting cavity for securing said housing to said aperture of said liquid container in a gas-tight manner, said housing further defining a cartridge cavity and a single fluid pathway extending between a first port terminating at said connecting cavity and a second port terminating at said cartridge cavity, said pathway being the sole fluid passage in said housing;

gas conduit means having a first and further end, said first end of said gas conduit permanently connected in a gas tight manner to said fluid pathway at said first port such that when said housing is secured to said liquid container said further end of said gas conduit means extends in to the interior of said liquid container so that a continuous gas tight pathway exists from said further end of said gas conduit, through said conduit, through said pathway in said housing to said cartridge cavity;

cover means for selectively opening and closing said cartridge cavity to provide pressurized sealing thereof;

a one shot disposable cartridge having a frangible portion and a shape suitable for being received in said cartridge cavity, said one shot sealed cartridge containing carbon-dioxide ($CO_2$) under pressure; and actuating mechanism for rupturing said frangible portion of said one shot disposable cartridge when said cartridge is in said sealed condition for containing pressure such that said pressurized carbon dioxide escapes from said cartridge cavity through said pathway in said housing and out of said further end of said gas conduit so that bubbles of pressurized $CO_2$ move up through a consumable liquid contained in said liquid container thereby carbonating said liquid.

12. The apparatus of claim 11 wherein said disposable cartridge contains 0.216 Liters of carbon dioxide at a pressure of between 95 PSI and 695 PSI at about room temperature.

13. The apparatus of claim 11 wherein said pressure in said cartridge produces between 20 PSI and 150 PSI pressure in said container.

* * * * *